US009915468B2

(12) United States Patent
You et al.

(10) Patent No.: US 9,915,468 B2
(45) Date of Patent: Mar. 13, 2018

(54) REFRIGERATOR

(71) Applicant: LG Electronics Inc., Seoul (KR)

(72) Inventors: Jimin You, Kyungsangnam-do (KR); Siyeon An, Kyungsangnam-do (KR); Yonghyun Kim, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 592 days.

(21) Appl. No.: 14/254,085

(22) Filed: Apr. 16, 2014

(65) Prior Publication Data

US 2014/0305155 A1 Oct. 16, 2014

(30) Foreign Application Priority Data

Apr. 16, 2013 (KR) ..... 10-2013-0041702

(51) Int. Cl.
*F25D 23/12* (2006.01)

(52) U.S. Cl.
CPC ..... *F25D 23/126* (2013.01); *F25D 2323/122* (2013.01)

(58) Field of Classification Search
CPC ..... F25D 23/126; F25D 2323/122
USPC ..... 62/338
See application file for complete search history.

(56) References Cited

U.S. PATENT DOCUMENTS 1,930,234 A * 10/1933 Feltault ..... A23G 9/12 366/243
1,967,431 A * 7/1934 Replogle ..... F25D 23/126 137/379
2,027,092 A * 1/1936 Dowell ..... F25D 21/14 62/291
2,028,926 A * 1/1936 Seeger ..... F25D 23/126 62/130
2,096,481 A * 10/1937 Frykdahl ..... F25D 3/04 62/288
2,121,281 A * 6/1938 Bosque ..... F16L 37/30 137/374
2,282,276 A * 5/1942 White ..... F25D 23/126 62/339

(Continued)

FOREIGN PATENT DOCUMENTS

GB 2282216 A * 3/1995 ..... F25C 1/04
JP 2000-314578 A 11/2000

(Continued)

OTHER PUBLICATIONS

Korean Notice of Allowance dated Oct. 17, 2014, on Korean patent appl. No. 10-2013-0041702 with English Translation, 4 Pages.

*Primary Examiner* — Keith Raymond
*Assistant Examiner* — Kirstin Oswald
(74) *Attorney, Agent, or Firm* — Fish & Richardson P.C.

(57) ABSTRACT

A refrigerator includes a water tank supporter arranged in a cabinet, a water tank that is connected to the water tank supporter and that defines a cavity, and a water supply platform that is movably connected to the water tank. The water supply platform includes a body portion that has a water inlet, a water outlet configured to discharge water to the cavity, and a water supply flow passage connected between the water inlet and the water outlet. The water supply platform also includes a movable portion configured to move the body portion such that the water inlet moves from an inside of the cabinet to an outside of the cabinet or vice versa.

33 Claims, 15 Drawing Sheets

(56) References Cited

U.S. PATENT DOCUMENTS

| | | | | | |
|---|---|---|---|---|---|
| 2,359,780 | A * | 10/1944 | Muffly | F25B 5/02 | 137/624.14 |
| 2,544,394 | A * | 3/1951 | Muffly | F25C 1/08 | 220/592.09 |
| 2,755,158 | A * | 7/1956 | Davidson | F25D 25/021 | 312/323 |
| 2,982,114 | A * | 5/1961 | Cobb | F25D 23/126 | 222/146.1 |
| 3,570,266 | A * | 3/1971 | Alvarez | F25C 1/00 | 62/338 |
| 3,914,957 | A * | 10/1975 | Jacobs | F25B 25/005 | 165/104.21 |
| 3,921,414 | A * | 11/1975 | Bright | F25C 1/04 | 62/188 |
| 5,156,021 | A * | 10/1992 | St-Gelais | B67D 3/043 | 312/408 |
| 5,306,077 | A * | 4/1994 | Trevaskis | A47F 3/063 | 312/122 |
| 2007/0089451 | A1* | 4/2007 | Lee | F25C 1/12 | 62/352 |
| 2008/0264090 | A1* | 10/2008 | Sowa | F25C 5/182 | 62/344 |
| 2012/0227433 | A1* | 9/2012 | Li | F25C 5/005 | 62/340 |

FOREIGN PATENT DOCUMENTS

| | | | |
|---|---|---|---|
| KR | 10-2011-0052550 | A | 5/2011 |
| KR | 10-2011-0136909 | A | 12/2011 |
| KR | 10-2012-0126183 | A | 11/2012 |

* cited by examiner

REFRIGERATOR

CROSS-REFERENCE TO RELATED APPLICATION

This application claims priority from Korean Application No. 10-2013-0041702, filed Apr. 16, 2013, the subject matter of which is incorporated herein by reference.

FIELD

The present disclosure relates to a refrigerator having a water tank arranged in a storage chamber thereof.

BACKGROUND

In general, a refrigerator is a device for storing food at a low temperature by using a refrigerating cycle having a compressor, a condenser, an expansion device, and an evaporator or a thermoelectric module.

The refrigerator may have storage chambers, such as a freezing chamber and a refrigerating chamber, formed therein, which may be opened/closed by doors.

The refrigerator may have a water tank mounted thereto for storage of water, for supplying water to an ice maker and the like.

SUMMARY

In one aspect, a refrigerator includes a cabinet, a water tank supporter arranged in the cabinet, a water tank that is supported by the water tank supporter and that defines a cavity, and a water supply platform that is movably connected to the water tank. The water supply platform includes a body portion that has a water inlet, a water outlet configured to discharge water to the cavity, and a water supply flow passage connected between the water inlet and the water outlet and a movable portion that is configured to move the body portion such that the water inlet moves from an inside of the cabinet to an outside of the cabinet or vice versa.

Implementations may include one or more of the following features. For example, the water tank may include a water tank movable portion movably connected to the water tank supporter. The water tank may have a water supply platform housing configured to house the water supply platform therein and the water supply platform housing has opened upper and front sides.

In some implementations, the water tank may have a guide rail configured to guide sliding movement of the movable portion of the water supply platform. In these implementations, the movable portion of the water supply platform may be located on a side plate of the body portion of the water supply platform and may extend in a front/rear direction. Further, in these implementations, the guide rail may include a first region and a second region that continues from the first region and that has a width greater than a width of the first region.

In some examples, the guide rail may include a third region that continues from the second region, that has a width less than a width of the second region, and that has a closed fore end. In these examples, the third region may have a sloped portion that is oriented at an acute angle from a horizontal plane.

In some implementations, the guide rail may include a groove portion in communication with the first region or the second region. In these implementations, the groove portion may have a vertical direction opening, a fore end in communication with the first region, and a closed rear end. Also, in these implementations, the movable portion may have a front/rear direction length shorter than a front/rear direction length of the groove portion.

In addition, the movable portion may include a hinge shaft movably connected to the water tank. And, the water supply platform may include a lower plate, an upper plate having the water inlet formed therein, and side plates connected between the upper plate and the lower plate, respectively. The water outlet may be formed in the lower plate and the water supply platform may include a water guide that defines the water supply flow passage. Also, the water supply platform may include a slidable plate having the water inlet formed therein and a tube that defines the water outlet.

In another aspect, a refrigerator includes a cabinet, a water tank supporter mounted in the cabinet, a water tank that is movably connected to the water tank supporter and that defines a cavity, and a water supply platform that is movably connected to the water tank. The refrigerator also includes a water pump, a first water line arranged in the cavity, and a second water line connected to the water pump. The water supply platform includes a body portion that has a water inlet, a water outlet configured to discharge water to the cavity, and a water supply flow passage connected between the water inlet and the water outlet. The water supply platform also includes a movable portion that is configured to move the body portion such that the water inlet moves from an inside of the cabinet to an outside of the cabinet or vice versa.

Implementations may include one or more of the following features. For example, the second water line may include a flexible tube connected to the first water line. The second water line may be separated from the first water line based on the water tank moving forward, and connected to the first water line based on the water tank retreating further into the cabinet. The water tank may have a water supply platform housing configured to house the water supply platform therein.

In some implementations, the water tank may have a guide rail configured to guide sliding movement of the movable portion. In these implementations, the guide rail may include a sloped portion configured to guide the movable portion in a manner that tilts the movable portion upward based on the movable portion moving forward.

In yet another aspect, a refrigerator includes a cabinet, a water tank supporter arranged in the cabinet, a water tank that is connected to the water tank supporter and that defines a cavity, and a water supply platform that is movably connected to the water tank. The water supply platform includes a body portion that has a water inlet, a water outlet configured to discharge water to the cavity, and a water supply flow passage connected between the water inlet and the water outlet. The water supply platform also includes a movable portion that is configured to move the body portion such that the water inlet moves from an inside of the cabinet to an outside of the cabinet or vice versa. In addition, the water tank includes a box that defines the cavity and an upper side guide member that is arranged at an upper side of the box and that is configured to guide movement of the water supply platform.

Implementations may include one or more of the following features. For example, the water tank may include a water tank movable portion connected to the water tank supporter and configured to move in forward and backward directions.

In some implementations, the upper side guide member may have a water supply platform housing configured to house the water supply platform. In these implementations, the water supply platform housing may have opened upper and front sides. Also, in these implementations, the water supply platform housing may have a guide rail configured to guide sliding movement of the movable portion. Further, in these implementations, the movable portion may be located on side plates of the body portion and may extend in a front/rear direction.

In addition, the movable portion may have a fore end that catches at a fore end of the guide rail based on the water inlet being moved to a position outside of the cabinet and a rear end that catches at a rear end of the guide rail based on the water inlet being moved to a position inside of the cabinet. And, the water supply platform may include a lower plate, an upper plate having the water inlet formed therein, and side plates connected between the upper plate and the lower plate, respectively. The water outlet may be formed in the lower plate, and the water supply platform may include a slidable plate having the water inlet and the water supply flow passage formed therein and a tube connected to the slidable plate that defines the water outlet.

DETAILED DESCRIPTION

Figure 1:
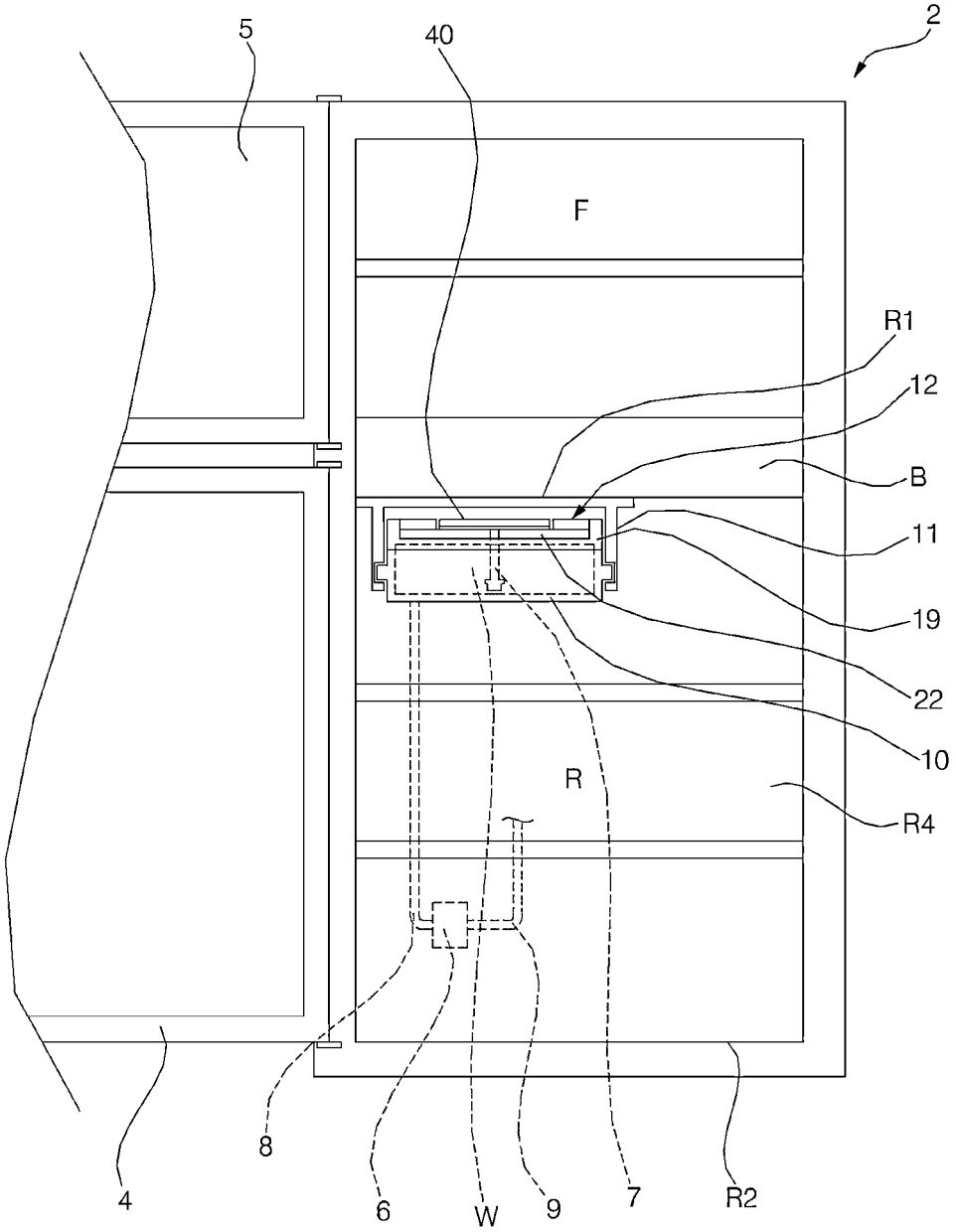
FIG. 1 is a front view illustrating an inside of an example refrigerator.

FIG. 1 illustrates an inside of an example refrigerator.

Referring to FIG. 1, the refrigerator may include a cabinet 2 having a storage chamber formed therein. The cabinet 2 may form an exterior appearance of the refrigerator. The storage chamber may be at least one of a refrigerating chamber R and a freezing chamber F. It is viable that the cabinet 2 has the refrigerating chamber R only, the freezing chamber F only, or both of the refrigerating chamber R and the freezing chamber F, together. The cabinet 2 has a refrigerating unit having a compressor, a condenser, an expansion device, and an evaporator mounted thereto. The cabinet 2 may have a machinery room formed therein for housing a compressor 3 (see FIG. 2). The refrigerator may include a refrigerating chamber door 4 for opening/closing the refrigerating chamber R. If both of the refrigerating chamber R and the freezing chamber F are formed individually, the refrigerator may include the refrigerating chamber door 4 for opening/closing the refrigerating chamber R, and a freezing chamber door 5 for opening/closing the freezing chamber F. The cabinet 2 may have the freezing chamber F formed over the refrigerating chamber R. The refrigerating chamber R and the freezing chamber F may be formed spaced from each other in a vertical direction with a barrier B interposed therebetween. The refrigerating chamber door 4 and the freezing chamber door 5 may be positioned in front of the cabinet 2, and may swing about vertical axes, respectively. When the refrigerating chamber door 4 is at a position of closing the refrigerating chamber R and the freezing chamber door 5 is at a position of closing the freezing chamber F, the freezing chamber door 5 may be positioned over the refrigerating chamber door 4.

The refrigerator includes a water tank 10 having a cavity W, a water tank supporter 11, and a water supply platform 12 mounted to the water tank 10 for supplying water to the cavity W. The water tank 10, the water tank supporter 11, and the water supply platform 12 make up a water tank unit.

The water tank 10 is mounted on, and supported by, the water tank supporter 11. The refrigerator may keep water to be supplied to a water requiring place stored in the water tank 10, and supply the water to the water requiring place when required. In this case, the water requiring place may be an ice maker for receiving the water from the water tank 10 to form ice, a water dispensing unit for receiving the water from the water tank 10 to dispense the water to an outside of the refrigerator, or the like. If ice is required from the ice maker, the refrigerator may supply the water from the water tank 10 to the ice maker. If a user inputs water to drink, the refrigerator supplies the water from the water tank 10 to the water dispensing unit and the water is dispensed through the water dispensing unit for use by the user. The water requiring place is not limited to the ice maker or the water dispensing unit, but may include different devices mounted to the refrigerator for using the water from the water tank 10. The refrigerator may include a water supply flow passage for guiding the water from the water tank 10 to the water requiring place, such as the ice maker or the water dispensing unit. The water supply flow passage may be connected to the water tank 10 or the water supply platform 12. If multiple water requiring places are included in the refrigerator, the water supply flow passage may include a common water supply flow passage for guiding the water from the water tank 10, and a plurality of branch water supply flow passages branched from the common water supply flow passage to different water requiring places. The refrigerator may have a water pump mounted to the water supply flow passage for pumping the water from the water tank 10 to the water requiring places. The refrigerator may have a water supply valve mounted to the water supply flow passage for turning on/off a water flow. If the water requiring place is singular, the water supply valve may be a two-way valve to turn on/off the water flow, and, if multiple water requiring places are provided, the water supply valve may be a three-way valve for selective supply of the water to one of the plurality of branch flow passages.

The water tank supporter 11 may be provided to the cabinet 2. The water tank supporter 11 may be arranged in the cabinet 2. Of the refrigerating chamber R and the freezing chamber F, the water tank supporter 11 may be positioned in the refrigerating chamber R.

The water supply platform 12 may be movably arranged to the water tank 10.

The refrigerator may include a water pump 6, a first water line 7 arranged in the cavity W, and a second water line 8 connected to the water pump 6. The water may be introduced to the water pump 6 from the cavity W passed through the first water line 7 and the second water line 8 in succession. The first water line 7 may guide the water in a state in which the first water line 7 is connected to the second water line 8 regardless of a position of the water tank 10 or the water supply platform 12. The second water line 8 may include a flexible tube connected to the first water line 7. In some examples, the first water line 7 is connected to or disconnected from the second water line 8 depending on a position of the water tank 10 or the water supply platform 12. The second water line 8 may be disconnected from the first water line 7 when the water tank 10 is moved forward, and may be connected to the first water line 7 when the water tank 10 is moved backward.

Figure 2:
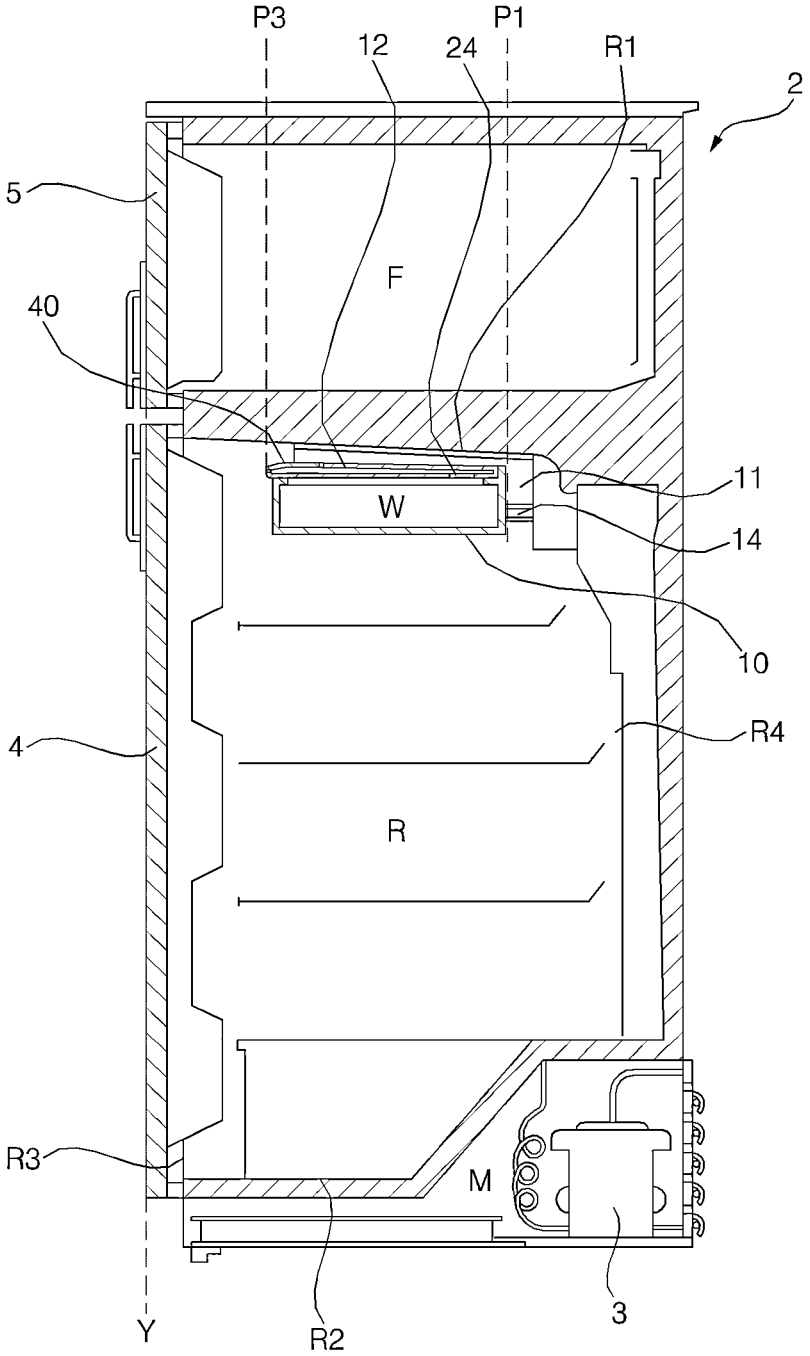
FIG. 2 is a sectional view illustrating an inside of an example refrigerator.
Figure 3:
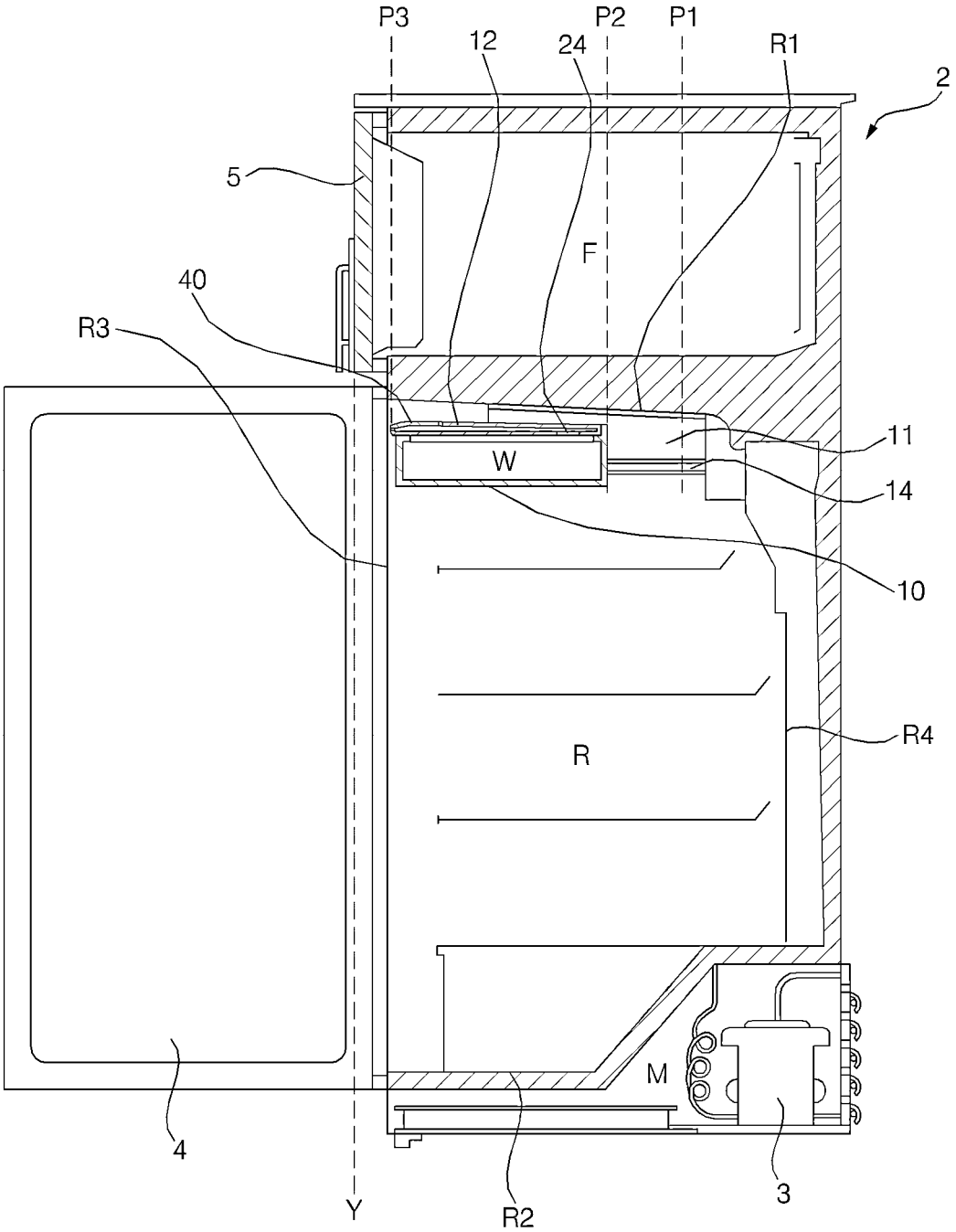
FIG. 3 is a sectional view illustrating the refrigerator in FIG. 2 showing a state in which the refrigerating chamber is opened, and the water tank is moved to a front side of the refrigerator.
Figure 4:
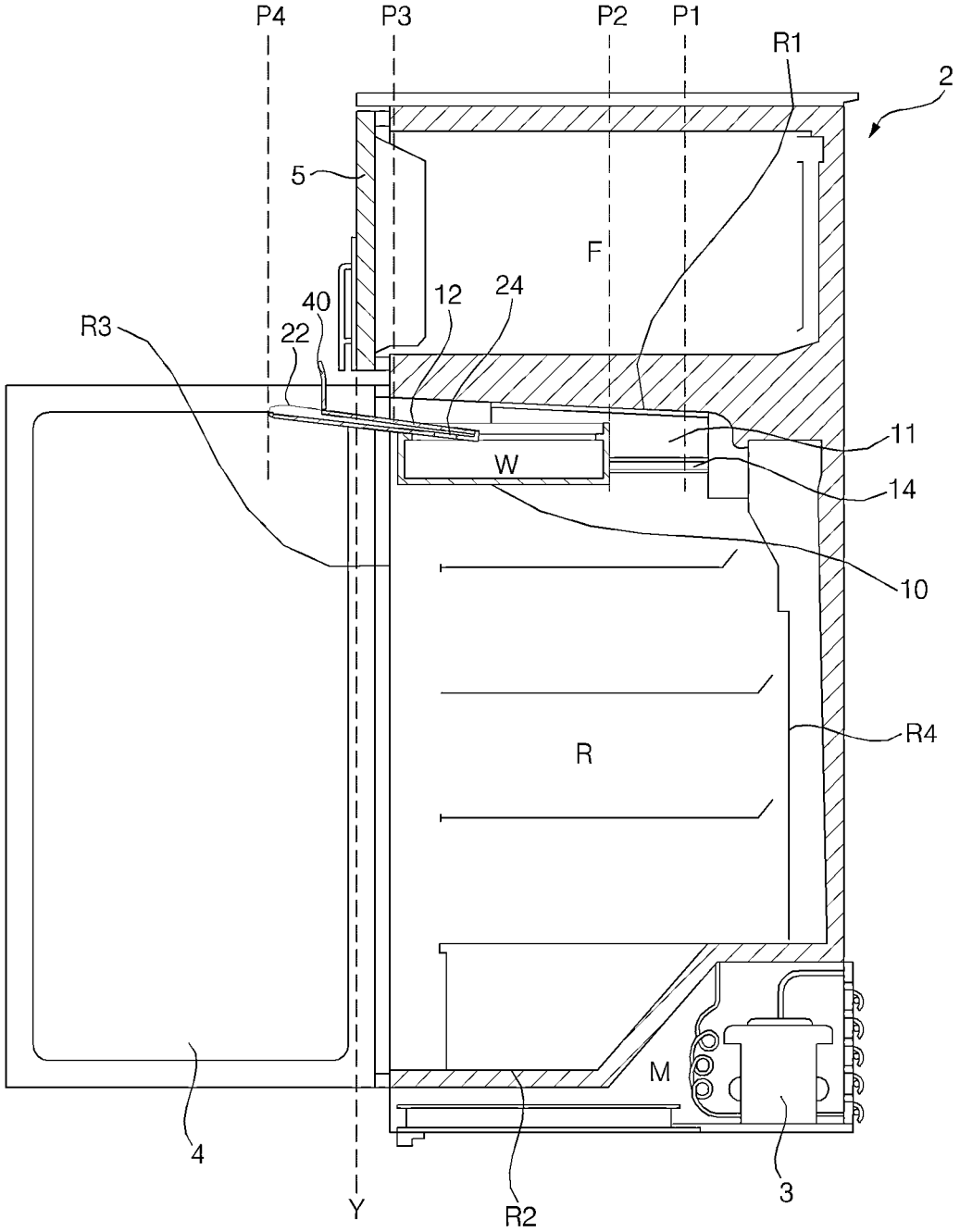
FIG. 4 is a sectional view illustrating the refrigerator in FIG. 3 showing a state in which the water supply platform is moved forward.
Figure 5:
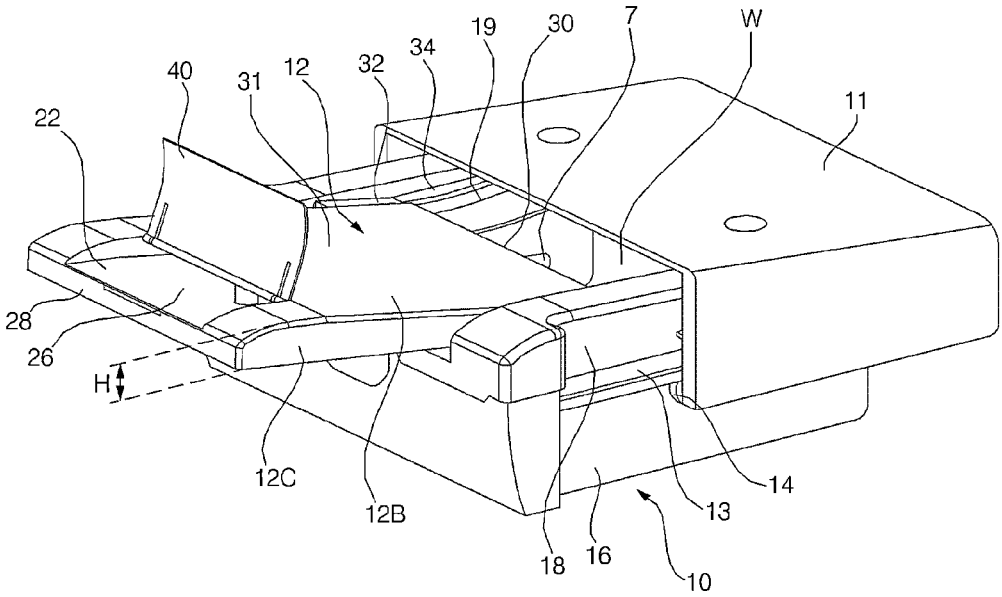
FIG. 5 is a perspective view illustrating the water tank unit in FIG. 3 showing a state in which the water supply platform is moved forward, and the water inlet is opened.
Figure 6:
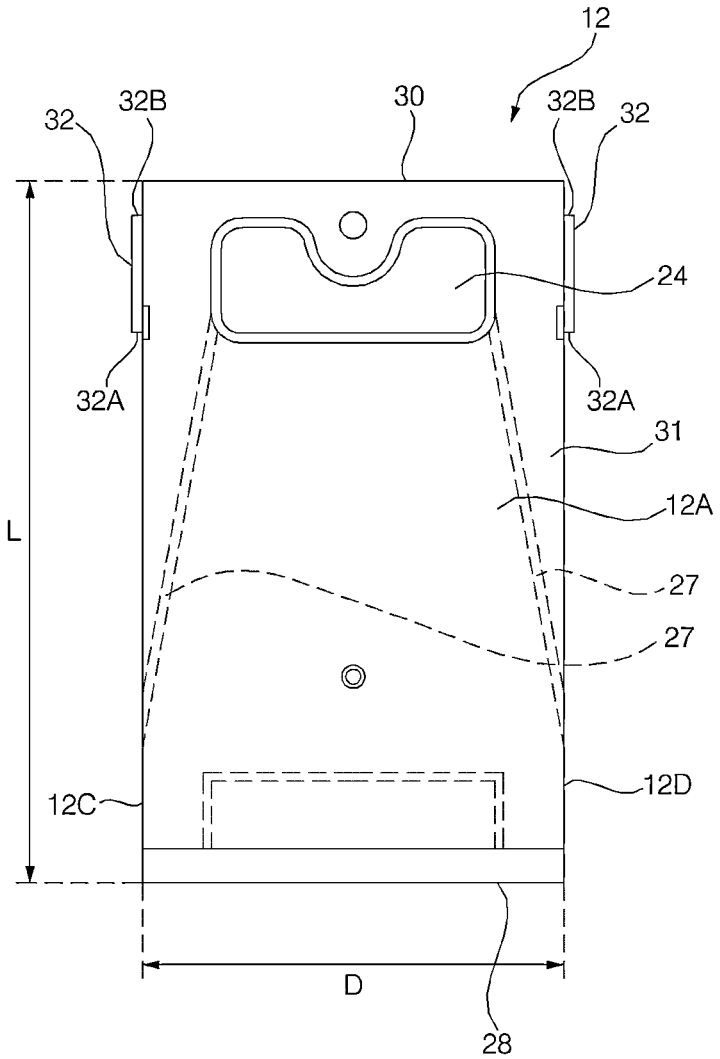
FIG. 6 is a bottom view of an example water supply platform in an example refrigerator.
Figure 7:
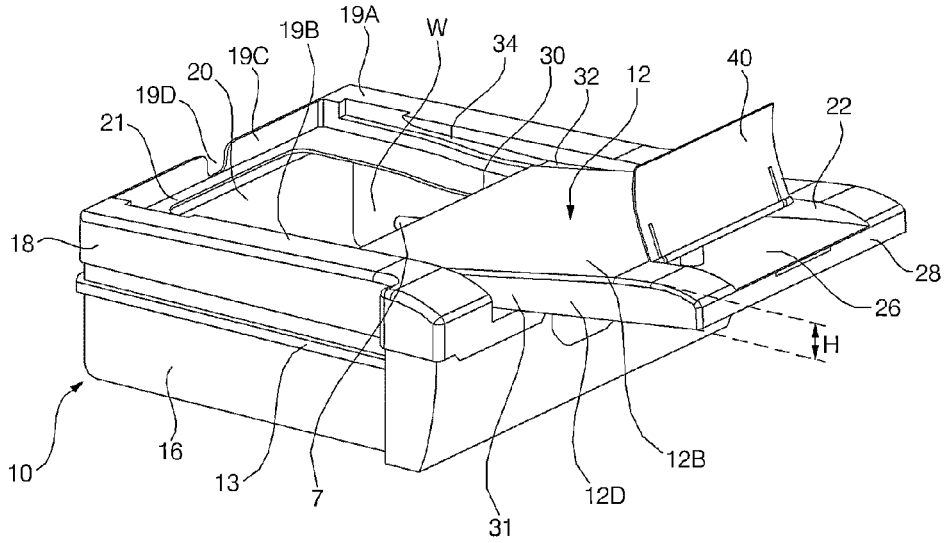
FIG. 7 is a perspective view illustrating an example water tank unit showing a state in which the water supply platform is moved forward, and the water inlet is opened.

FIG. 2 illustrates an inside of an example refrigerator, FIG. 3 is a sectional view illustrating the refrigerator in FIG. 2 showing a state in which the refrigerating chamber is opened and the water tank is moved to a front side of the refrigerator, FIG. 4 is a sectional view illustrating the refrigerator in FIG. 3 showing a state in which the water supply platform is moved forward, FIG. 5 is a perspective view illustrating the water tank unit in FIG. 3 showing a state in which the water supply platform is moved forward and the water inlet is opened, FIG. 6 is a bottom view of an example water supply platform, and FIG. 7 is a perspective view illustrating an example water tank unit showing a state in which the water supply platform is moved forward and the water inlet is opened.

The water tank 10 may be positioned in the refrigerating chamber R supported by the water tank supporter 11, and maintained at a low temperature owing to cold air in the refrigerating chamber R.

The water tank 10 may be movably mounted to the water tank supporter 11. The water tank 10 may be mounted to the water tank supporter 11 to be slidable in front/rear directions. The water tank 10 may be mounted to the water tank supporter 11 to be slidable in front/rear directions, horizontally. In this case, the front/rear direction horizontal sliding of the water tank 10 may include, not only front/rear direction linear sliding in a state in which the water tank 10 is arranged horizontally, but also front/rear direction tilted sliding in a state in which the water tank 10 is arranged tilted by an angle in a range of below 30° from a horizontal plane. The water tank 10 may include a water tank movable portion 13 movably mounted to the water tank supporter 11. The water tank movable portion 13 may be mounted to the water tank supporter 11 to move forward/backward. The water tank supporter 11 may have a movable portion guide 14 provided thereto for guiding the water tank movable portion 13 when the water tank 10 slides. The water tank 10 may have the water tank movable portion 13 provided to at least one of left/right side plates thereof, and the water tank supporter 11 may have the movable portion guide 14 formed at a side thereof facing the water tank 10. The water tank movable portion 13 may be guided in a length direction of the movable portion guide 14 in a state in which at least a portion of the water tank movable portion 13 is inserted in the movable portion guide 14. When the water tank movable portion 13 is sliding along the movable portion guide 14, the water tank 10 may move forward in a front direction of the refrigerating chamber R, or move backward in a direction coming closer to a rear wall R4 of the refrigerating chamber R. In this case, the movable portion guide 14 may be recessed in the water tank supporter 11. The movable portion guide 14 may include one pair of guide ribs projected vertically from the water tank supporter 11 spaced from each other. In some implementations, the refrigerator may have the water tank 10 with the movable portion guide 14 provided to at least one of the left/right side plates thereof, and the water tank supporter 11 with the water tank movable portion 13 formed on side plates thereof. The refrigerator may have rollers mounted to at least one of the water tank movable portion 13 and the movable portion guide 14 for assisting sliding of the water tank 10. The rollers mounted to the water tank movable portion 13 roll along the movable portion guide 14 for assisting smooth sliding of the water tank 10, and the rollers mounted to the movable portion guide 14 roll along the water tank movable portion 13 for assisting smooth sliding of the water tank 10.

The water tank 10 may move to a water tank retreat position (Or, a first position: P1) when the water tank 10 retreats to the inside of the cabinet 2. The water tank 10 may move to a water tank advance position (Or, a second position: P2) when the water tank 10 advances in a direction of moving to an outside of the cabinet 2 from the water tank retreat position P1. The water tank 10 may move to the water tank retreat position P1 when the water tank 10 is moved to a rear side as much as possible in a state the water tank 10 is supported by the water tank supporter 11. The water tank 10 may move to the water tank advance position P2 when the water tank 10 is moved to a front side as much as possible in a state the water tank 10 is supported by the water tank supporter 11. The water tank 10 may slide between the water tank retreat position P1 and the water tank advance position P2 while supported and guided by the water tank supporter 11. In this case, the water tank retreat position P1 may be a position at which the water tank 10 is inserted to the inside of the refrigerating chamber R as much as possible, and the water tank advance position P2 may be a position at which the water tank 10 is moved to a front side of the refrigerating chamber R as much as possible while the water tank 10 maintains a state in which the water tank 10 is not separated from the water tank supporter 11, but supported by the water tank supporter 11. When the water tank 10 is positioned at the water tank advance position P2, the water tank 10 may be tilted upward or downward within a range of 30°. Depending on a storage situation of the refrigerating chamber R, a position of the water tank 10 may be determined. The refrigerating chamber R may have food stored close to a fore end R3 of the refrigerating chamber R. In this case, the water tank 10 may retreat to a position close to the water tank retreat position P1 or to the water tank retreat position P1. The refrigerating chamber R may have food stored close to a rear wall R4 of the refrigerating chamber R. In this case, the water tank 10 may advance to a position close to the water tank advance position P2 or to the water tank advance position P2. When water is supplied to the water supply platform 12, the water tank 10 may advance to a position close to the water tank advance position P2 or to the water tank advance position P2, and the water supply platform 12 may be drawn to an outside of the refrigerating chamber R as much as possible. In order to minimize the water tank 10 from interfering with the refrigerating chamber door 4 at a time during which water is not supplied to the water supply platform 12, the water tank 10 may be moved to the water tank retreat position P1 or between the water tank retreat position P1 and the water tank advance position P2.

The water tank 10 may include a box 16 having the cavity W formed therein, and an upper side guide member 18 arranged to an upper side of the box 16 for guiding the water supply platform 12. The box 16 may have a hexahedral shape with an opened upper side and the cavity W formed therein. In some examples, the water tank 10 may guide the water supply platform 12 with the box 16 without the upper side guide member 18. Hereinafter, the description relates to a case in which the water tank 10 includes the box 16 and the upper side guide member 18. The water tank 10 may be moved as at least one of the box 16 or the upper side guide member 18 is guided by the water tank supporter 11.

The water tank 10 may have a water supply platform housing 19 formed thereon for inserting and housing the water supply platform 12 therein. The water supply platform housing 19 may be formed on an upper side of the water tank 10. The water supply platform 12 may be inserted and housed in the water supply platform housing 19, entirely, or partly.

The water supply platform housing 19 may have opened upper and front sides. The water supply platform housing 19 may be a recess formed in the upper side of the water tank 10. The water supply platform housing 19 may include a left plate portion 19A, a right plate portion 19B and a rear plate portion 19C. The water supply platform housing 19 may be formed at the upper side guide member 18. The water supply platform 12 may move down between the left plate portion 19A and the right plate portion 19B of the water supply platform housing 19 from an upper side position of the water supply platform housing 19 and may be housed in the water supply platform housing 19. The water supply platform 12 may slidably advance in a front direction between the left plate portion 19A and the right plate portion 19B of the water supply platform housing 19. In a state in which the water supply platform 12 is slidably moved in the front direction, the water supply platform 12 may retreat between the left plate portion 19A and the right plate portion 19B of the water supply platform housing 19. The water supply platform 12 may be guided such that the water supply platform 12 is lifted upward between the left plate portion 19A and the right plate portion 19B of the water supply platform housing 19. Excessive movement of the water supply platform 12 in a rear wall R4 direction of the refrigerating chamber R may be limited as the water supply platform 12 is blocked by the rear plate portion 19C. The water tank 10 may have a water line avoidance portion 19D formed therein for preventing the first water line 7 from interfering with the water tank 10. The water line avoidance portion 19D may be formed in the rear plate portion 19C. The water line avoidance portion 19D may be formed in a shape of an opened hole in a front/rear direction, or in a shape of a slit which opens a portion of an upper edge of the rear plate portion 19C.

The water tank 10 may have an opening 20 formed therein for introduction of water dropping from the water supply platform 12 to the cavity W. The water tank 10 may have a plate portion 21 formed thereon. The plate portion 21 may be formed on the water tank 10 in a shape of a rectangular ring section, with the opening 20 in a vertical direction. The plate portion 21 can block the water supply platform 12 from falling into the cavity W. The plate portion 21 can block the water from infiltrating into a gap between the water supply platform housing 19 and the water supply platform 12 from the cavity W. The opening 20 and the plate portion 21 may be formed on the upper side guide member 18. The water supply platform 12 at edges thereof may be caught by the plate portion 21, preventing the water supply platform 12 from falling freely.

The water tank supporter 11 may support the water tank 10 as well as guide sliding of the water tank 10. Though the water tank supporter 11 may be provided in either the cabinet 2 or the refrigerating chamber door 4, the water tank supporter 11 is shown as being provided to the cabinet 2. If the water tank supporter 11 is provided to the refrigerating chamber door 4, the water tank 10 is arranged to a refrigerating chamber door 4 side. In this case, due to an increased load acting on the refrigerating chamber door 4, user's opening/closing of the refrigerating chamber door 4 may become difficult, and the water supply to the water requiring place mounted to the cabinet 2 may be more difficult. If the water tank supporter 11 is provided to the cabinet 2, no load of the water tank 10 will act on the refrigerating chamber door 4, and the water supply to the water requiring place mounted to the cabinet 2 may be easier. In a refrigerator with the water tank supporter 11 provided, not to the refrigerating chamber door 4, but to the cabinet 2, the water tank supporter 11 may be positioned in the refrigerating chamber R, and the water tank 10 may move within the refrigerating chamber R. The water tank supporter 11 may be provided to the refrigerating chamber R so as not to be projected to an outside of the refrigerating chamber R. The water tank supporter 11 may be projected from the cabinet 2 as one unit therewith for supporting the water tank 10. The water tank supporter 11 may be fabricated separate from the cabinet 11 and secured to the cabinet 2.

Of an inside space of the refrigerating chamber R, the refrigerating chamber R has low possibility of positioning food and the like in a space close to an upper side wall R1 of the refrigerating chamber R, and the water tank 10, the water tank supporter 11, and the water supply platform 12 may be positioned close to the upper side wall R1 rather than the lower side wall R2 of the refrigerating chamber R. If the inside of the refrigerating chamber R is divided vertically into three spaces of an upper side, middle, and a lower side, the water tank supporter 11 may be provided to the upper side of the inside of the refrigerating chamber R, and the water tank 10 and the water supply platform 12 may move at the upper side of the inside of the refrigerating chamber R.

The water tank supporter 11 may support and guide a left side and a right side of the water tank 10. The water tank supporter 11 has a left side water tank supporter and a right side water tank supporter arranged spaced from each other in a left/right direction to form a pair of supporters for supporting and guiding the water tank 10. The water tank supporter 11, configured as one member having a left side plate, a right side plate and an upper side plate, may be secured to the cabinet 2. The water tank supporter 11 may have the left side plate supporting and guiding a left side portion of the water tank 10, and the right side plate supporting and guiding a right side portion of the water tank 10. The water tank supporter 11 may be mounted to the upper side wall R1 of the refrigerating chamber R with fastening members, such as screws, or with hooking structures, such as one or more hooks. The water tank supporter 11 may be mounted to the refrigerating chamber R at a fixed position, with a fore end thereof positioned in rear of the fore end R3 of the refrigerating chamber R.

The water supply platform 12 may include a body portion 31 and a movable portion 32. The body portion 31 may receive water supplied from an outside of the refrigerator R and guide the received water to the cavity W. The movable portion 32 may enable movement of the water supply platform 12. The body portion 31 may have a water inlet 22 for receiving water from an outside of the water supply platform 12, an water outlet 24 for discharging the received water to the cavity W, and a water supply flow passage 26 connected between the water inlet 22 and the water outlet 24. The movable portion 32 may move the body portion 31 to cause the water inlet 22 to move from an inside of the cabinet 2 to an outside of the cabinet 2. If the water supply platform 12 moves forward along the water tank 10, the water inlet 22 can move to the outside of the cabinet 2. The movable portion 32 may move the body portion 31 such that the water inlet 22 moves from the outside of the cabinet 2 to the inside of the cabinet 2. If the water supply platform 12 moves backward along the water tank 10, the water inlet 22 may move to the inside of the cabinet 2.

The water supply flow passage 26 may be formed in the water supply platform 12. The water supply flow passage 26 may be formed in the body portion 31 of the water supply platform 12. The water supply platform 12 may have the water inlet 22 formed in an upper side of a front thereof, and the water outlet 24 formed in a lower side of a rear thereof. The water supply platform 12 may have a closed upper side except the water inlet 22. The water supply platform 12 may be formed in a box shape, a bar shape, or a plate shape with the water supply flow passage 26 formed therein. The water supply platform 12 may have a left/right direction width D and a front/rear direction length L formed larger than an upper/lower direction height. The water supply platform 12 may include a lower plate 12A, an upper plate 12B, and side plates 12C and 12D which are connected between the lower plate 12A and the upper plate 12B, respectively. The upper plate 12B and the lower plate 12A may be spaced from each other in a vertical direction. The side plates 12C and 12D may include a left side plate 12C connected between a left side portion of the lower plate 12A and a left side portion of the upper plate 12B, and a right side plate 12D connected between a right side portion of the lower plate 12A and a right side portion of the upper plate 12B. The water inlet 22 may be formed close to the fore end 28 of the water supply platform 12, rather than the rear end 30 of the water supply platform 12, and the water outlet 24 may be formed close to the rear end 30, rather than the fore end 28 of the water supply platform 12. The water inlet 22 may be opened in the upper plate 12B. The water inlet 22 may be opened in the upper plate 12B in a vertical direction. The water outlet 24 may be formed in the lower plate 12A. The water outlet 24 may be opened in the lower plate 12A in the vertical direction. The water supply platform 12 may further include a front plate which forms the fore end 28 of the water supply platform 12, and a rear plate which forms the rear end 30 of the water supply platform 12. The water outlet 24 may be opened in the rear plate in a horizontal direction. If water is supplied to the water inlet 22 from an outside of the water supply platform 12, the water supplied to the water inlet 22 may be guided through the water supply flow passage 26 to the water outlet 24. The water guided to the water outlet 24 may be introduced to the cavity W through the water outlet 24. The water supply platform 12 may include a water guide 27 which forms the water supply flow passage 26. The water guide 27 may be formed between the upper plate 12B and the lower plate 12A. The water guide 27 may have a left/right direction width of the water supply flow passage 26 which becomes smaller as the water supply flow passage 26 goes toward the water outlet 24. The water guide 27 may include one pair of ribs formed between the lower plate 12A and the upper plate 12B spaced in left/right directions. The water supply platform 12 may include a sliding plate having the water inlet 22 formed therein, and a tube having the water outlet 24 formed therein. The water introduced to the water inlet 22 may be guided along the sliding plate, and may be supplied to the cavity W through the tube.

The water supply platform 12 may be movably arranged to the water tank 10. The water supply platform 12 may move together with the water tank 10 when the water tank 10 moves, and may move beyond a fore end of the water tank 10 in a state in which a position of the water tank 10 is fixed. Although the water supply platform 12 may be movably arranged to the water tank supporter 11, in this case, a width of the water supply platform 12 drawable beyond the fore end of the water tank supporter 11 may become short. Alternatively, if the water supply platform 12 is movably arranged to the water tank 10, the water supply platform 12 may move beyond a fore end of the water tank 10 in a state in which the water tank 10 is moved forward, allowing the water supply platform 12 to have a large width movable forward. The refrigerator may have the water inlet 22 movable in two stages as the water tank 10 moves forward as well as the water supply platform 12 moves forward. The water supply platform 12 may be slidably guided by the water tank 10, or rotatably guided by the water tank 10. In some implementations, the water supply platform 12 may be slidably guided by the water tank 10. The water supply platform 12 may be slidably guided forward/backward by the water tank 10. The water supply platform 12 may be slidably guided forward/backward on the water tank 10. In this case, the forward/backward sliding of the water supply platform 12 may include, not only forward/backward linear sliding in a state in which the water supply platform 12 is arranged horizontally, but also forward/backward linear sliding in a state in which the water supply platform 12 is arranged tilted at an angle below 30° from a horizontal plane. The water supply platform 12 may slide horizontally when the water inlet 22 is positioned in the refrigerating chamber R and may slide tilted upward when the water inlet 22 is positioned on an outside of the refrigerating chamber R.

The water tank 10 may have a guide rail 34 that guides sliding of the movable portion 32 of the water supply platform 12. The movable portion 32 may extend in a length direction of the guide rail 34. The movable portion 32 may project from a side of the body portion 31 in a lateral direction. The movable portion 32 may be formed on the side plates 12C and 12D of the body portion 31. The movable portion 32 may be formed on the side plates 12C and 12D of the body portion 31 extended in a front/rear direction. The movable portion 32 may be formed on the left side plate 12C and the right side plate 12D of the body portion 31. The movable portion 32 may have a plate or bar shape of which a front/rear direction length is longer than a left/right direction length. The movable portion 32 may include a fore end 32A which is caught at a fore end 34A of the guide rail 34 when the water inlet 22 is positioned on the outside of the cabinet 2. The movable portion 32 may include a fore end 32B which is caught at a rear end 34B of the guide rail 34 when the water inlet 22 is positioned in the cabinet 2. If formed on the water supply platform 12, the movable portion 32 may be formed on a rear portion of the water supply platform 12, rather than a front portion of the water supply platform 12. The movable portion 32 may be formed on the water tank 10, and in this case, the movable portion 32 may be formed on the front portion of the water tank 10, rather than the rear portion of the water tank 10. The guide rail 34 may guide the movable portion 32 when the water supply platform 12 moves, and a movable direction or a largest movable width of the water supply platform 12 may be fixed depending on a shape and a length of the guide rail 34. If the movable portion 32 is formed on the water supply platform 12 and the guide rail 34 is formed in the water tank 10, the guide rail 34 may be formed in the upper side guide member 18. If the movable portion 32 is formed on the water tank 10 and the guide rail 34 is formed in the water supply platform 12, the movable portion 32 may be formed on the upper side guide member 18. The guide rail 34 will be described later, in detail.

The refrigerator may further include a water inlet door 40 mounted to the water supply platform 12 for opening/closing the water inlet 22. The water inlet door 40 may be rotatably or slidably arranged on the water supply platform 12. The water inlet door 40 may be operated to open the water inlet 22 when water is supplied to the water supply platform 12 from an outside of the refrigerator, and may be moved to the water inlet 22 to prevent foreign matter from infiltrating through the water inlet 22 while water is not supplied to the water supply platform 12 from the outside of the refrigerator. If the water inlet door 40 is rotatably arranged on the water supply platform 12, the water inlet door 40 may rotate centered on a hinge shaft which is arranged to the water inlet door 40 or the water supply platform 12, horizontally. If the hinge shaft is formed on the water inlet door 40, the water supply platform 12 may have a hinge groove formed therein for rotatably housing the hinge shaft, and, if the hinge shaft is formed on the water supply platform 12, the hinge groove may be formed in the water inlet door 40 for rotatably housing the hinge shaft. The water inlet door 40 may be arranged to the water supply platform 12 to be rotatable in a vertical direction. When the water tank 10 is moved forward on the water tank supporter 11 as the water supply platform 12 is moved forward on the water tank 10, the water inlet door 40 may be positioned outside of the refrigerating chamber R.

The water supply platform 12 may move to a water inlet retreat position (Or, a third position: P3) positioned over the water tank 10. The water supply platform 12 may move to a water inlet advance position (Or, a fourth position: P4) which is an advanced position from the water inlet retreat position P3 in a direction facing the outside of the cabinet 2.

Referring to FIG. 2, when the water tank 10 is at the water tank retreat position P1, the water supply platform 12 may move to the water inlet retreat position P3 at which point the water inlet 22 is positioned in the refrigerating chamber R. The water supply platform 12 may move to the water inlet retreat position P3 positioned over the water tank 10. The water supply platform 12 may cover the cavity W at the time the water supply platform 12 is at the water inlet retreat position P3. In this case, the water supply platform 12 may have the water inlet 12 positioned behind the fore end R3 of the refrigerating chamber R, and the water inlet 12 may be positioned in the refrigerating chamber R. And, the water supply platform 12 may have the water inlet 12 positioned behind a vertical extension line Y which is a downward extension line from the fore end of the freezing chamber door 4.

Referring to FIG. 3, when the water tank 10 is at the water tank advance position P2, the water supply platform 12 may maintain the water inlet retreat position P3 at which point an entire or a majority of the water supply platform 12 is positioned in the refrigerating chamber R together with the water tank 10. In this case, the water supply platform 12 may have the water inlet 22 positioned behind the fore end R3 of the refrigerating chamber. And, the water supply platform 12 may have the water inlet 22 positioned behind the vertical extension line Y which is a downward extension line from the fore end of the freezing chamber door 4.

Referring to FIG. 4, when the water tank 10 is at the water tank advance position P2, the water supply platform 12 may have the water inlet 22 moved to the water inlet advance position P4 positioned in front of the refrigerating chamber R. When the water tank 10 is at the water tank advance position P2 and the water supply platform 12 is at the water inlet advance position P4, the water inlet 22 may move to the outside of the cabinet 2. When the water supply platform 12 is at the water inlet advance position P4, the water supply platform 12 may open a portion of the cavity W. When the freezing chamber door 5 is at a freezing chamber F closing position and the water tank 10 is at the water tank advance position P2, the water supply platform 12 may slide along the water tank 10. If the water supply platform 12 reaches the water inlet advance position P4, at least a portion of the water inlet 22 may be positioned in front of a lower side of a fore end of the freezing chamber door 5. When the water tank 10 is at the water tank advance position, the water inlet advance position P4 may be a position at which the water inlet 22 is positioned in front of the refrigerating chamber R, or a position in which at least a portion of the water inlet 22 is positioned in front of a lower side of the fore end of the freezing chamber door 5. That is, the water inlet 22 of the water supply platform 12 may be entirely or partly positioned in front of a vertical extension line Y which is a downward extension line from the fore end of the freezing chamber door 4.

The refrigerator may be a side by side type refrigerator having the freezing chamber F and the refrigerating chamber spaced in a left/right direction, wherein, if the water tank 10 is at the water tank advance position P2, and the water supply platform 12 is at the water inlet advance position P4, the water inlet 22 may be positioned in front of the refrigerating chamber R. That is, the water inlet 22 of the water supply platform 12 may be entirely or mostly positioned in front of the fore end R3 of the refrigerating chamber R.

The refrigerator may be a top freezing type refrigerator having the water tank supporter 11 mounted to an upper side of an inside of the refrigerating chamber R, and the freezing chamber F is positioned over the refrigerating chamber R. In this case, if the water inlet 22 is positioned under a lower side of the fore end of the freezing chamber door 5, it may not be easy to supply water from the outside of the cabinet 2 to the water inlet 22, and a user may have to open the freezing chamber door 5 for supplying water every time water is supplied. However, as shown in FIG. 4, when the water tank 10 is at the water tank advance position P2 and the water supply platform 12 is at the water inlet advance position P4, if at least a portion of the water inlet 22 is positioned in front of the lower side of the fore end of the freezing chamber door 5, the user may supply water to the water inlet 22 in the water supply platform 12 without opening the freezing chamber door 5.

The two stage movable structure of the water tank 10 and the water supply platform 12 may be used in a refrigerator having the freezing chamber F positioned over the refrigerating chamber R, and the water tank 10 positioned at an upper side of an inside of the refrigerating chamber R. In a case of the side by side type refrigerator having the freezing chamber F and the refrigerating chamber R spaced in a left/right direction, a position of the water inlet 22 may be changed to an outside of the refrigerating chamber R as much as possible, enabling easier water supply than a case in which the water inlet 22 is positioned at the refrigerating chamber R.

Figure 8:
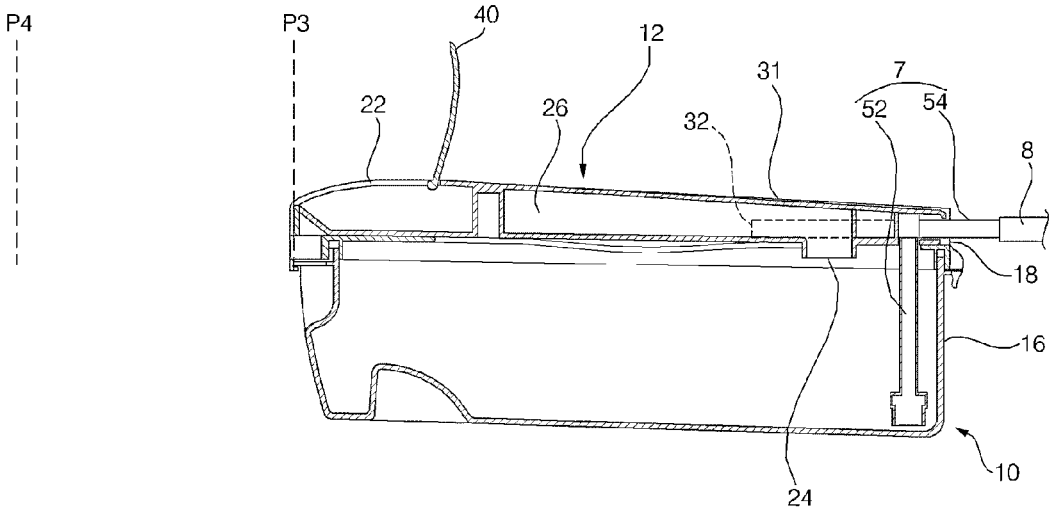
FIG. 8 is a sectional view illustrating an example water tank unit showing a state in which the water supply platform is positioned at a water inlet retreat position.
Figure 9:
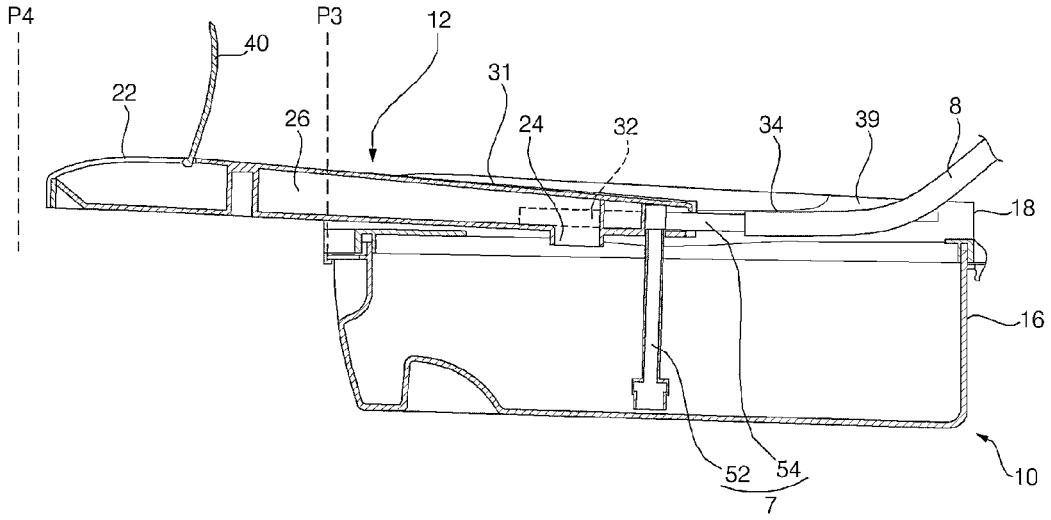
FIG. 9 is a sectional view illustrating an example water tank unit showing a state in which the water supply platform is positioned between a water inlet retreat position and a water inlet advance position.
Figure 10:
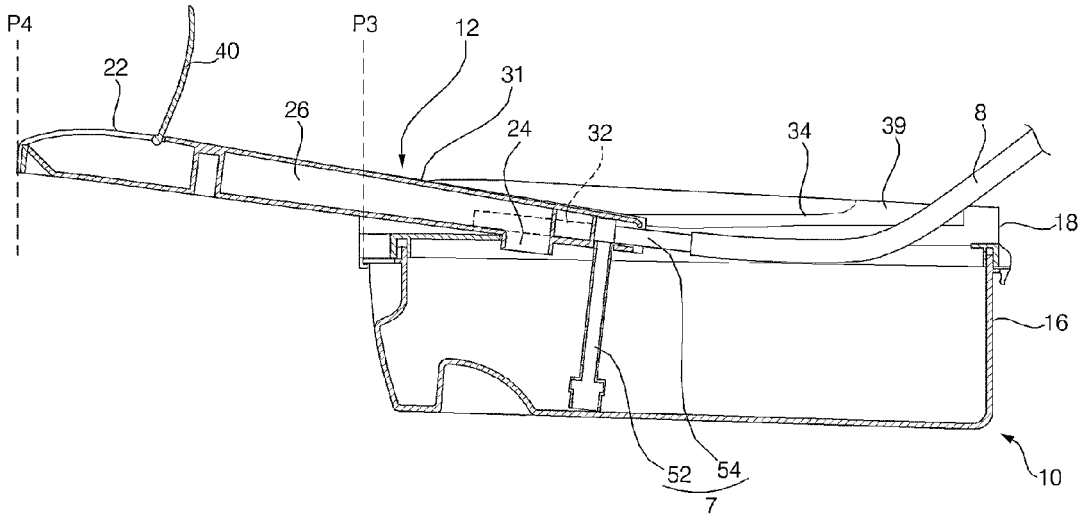
FIG. 10 is a sectional view illustrating an example water tank unit showing a state in which the water supply platform is positioned at a water inlet advance position in a refrigerator.
Figure 11:
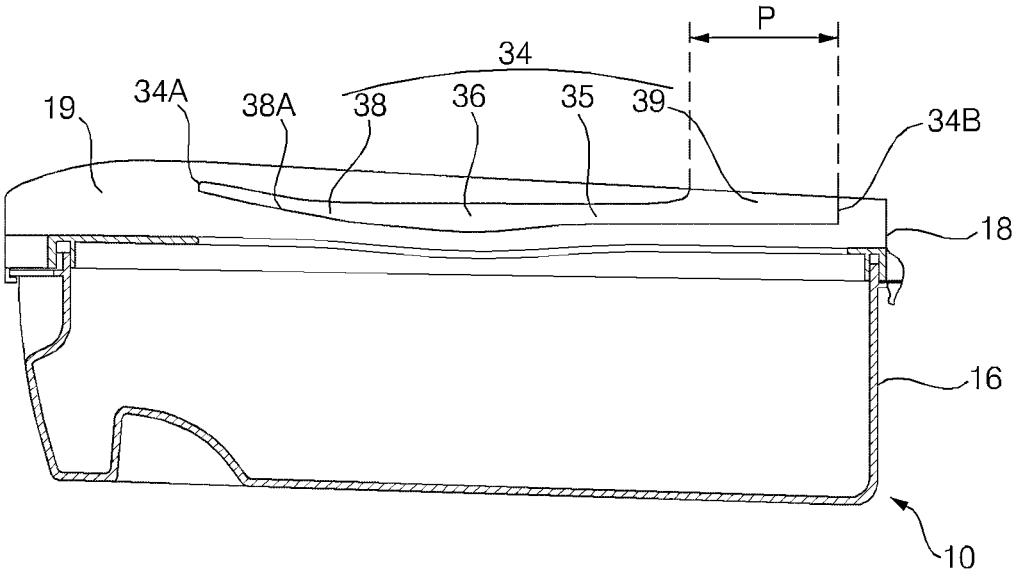
FIG. 11 illustrates a side view illustrating an example enlarged guide rail in an example refrigerator.

FIG. 8 illustrates an example water tank unit showing a state in which the water supply platform is positioned at a water inlet retreat position, FIG. 9 illustrates an example water tank unit showing a state in which the water supply platform is positioned between a water inlet retreat position and a water inlet advance position, FIG. 10 illustrates an example water tank unit showing a state in which the water supply platform is positioned at a water inlet advance position, and FIG. 11 illustrates an enlarged example guide rail.

The guide rail 34 may guide the movable portion 32 to be tilted upward when the water supply platform 12 is moving toward the water inlet advance position P4, and may guide the movable portion 32 horizontally when the water supply platform 12 is moving toward the water inlet retreat position P3.

When the movable portion 32 is moving forward, the guide rail 34 may guide the movable portion 32 to be tilted upward. The guide rail 34 may include a sloped portion 38A for guiding the movable portion 32 to be tilted upward when the movable portion 32 is moving forward. The sloped portion 38A may be formed to have an acute angle from a horizontal plane. The guide rail 34 may guide the movable portion 32 horizontally when the movable portion 32 is retreating. As shown in FIG. 8, when the water supply platform 12 is positioned at the water inlet retreat position P3, the water supply platform 12 may be positioned horizontal to, or close to horizontal to, an upper side of the water tank 10, and, as shown in FIG. 10, when the water supply platform 12 is positioned at the water inlet advance position P4, the water supply platform 12 may be positioned tilted on the upper side of the water tank 10 in a range of 5°~30° from the horizontal plane. As shown in FIGS. 8 to 10, the water supply platform 12 may be tilted further as the water supply platform 12 moves from the water inlet retreat position P3 to the water inlet advance position P4, and the water supply platform 12 may be tilted less as the water supply platform 12 moves from the water inlet advance position P4 to the water inlet retreat position P3.

The guide rail 34 may be formed in the water supply platform housing 19. The guide rail 34 may be formed in the left plate portion 19A of the water supply platform housing 19 and the right plate portion 19B of the water supply platform housing 19. The movable portion formed on a left side of the body portion 31 may be guided by the guide rail formed on the left plate portion 19A of the water supply platform housing 19, and the movable portion formed on a right side of the body portion 31 may be guided by the right plate portion 19B of the water supply platform housing 19.

The guide rail 34 may include a first region 35, and a second region 36 continued from the first region 35 to have a width higher than the first region 35. The first region 36 may be positioned in front of the first region 35. The guide rail 34 may include a third region 38 continued from the second region 36 to have a width higher than the second region 36 and a closed fore end 34A.

The third region 38 may guide the movable portion 32 along an upward slope. The third region 38 may include a sloped portion 38A having an acute angle from a horizontal plane. The third region 38 may be formed of the sloped portion 38A entirely, or partly.

The guide rail 34 may include a movable portion in/out groove portion 39 having an opening for the movable portion 32 to move in/out of the first region 35 or the second region 36. The movable portion in/out groove portion 39 may be formed to be in communication with the first region 35 or the second region 36. The movable portion in/out groove portion 39 may be formed to have the opening in a vertical direction. If the movable portion in/out groove portion 39 is formed to be in communication with the first region 35, the movable portion 32 may proceed to the first region 35 through the movable portion in/out groove portion 39, and the movable portion 32 may be pulled out of the first region 35 through the movable portion in/out groove portion 39. If the movable portion in/out groove portion 39 is formed to be in communication with the second region 36, the movable portion 32 may proceed to the second region 35 through the movable portion in/out groove portion 39, and the movable portion 32 may be pulled out of the second region 35 through the movable portion in/out groove portion 39. If the movable portion in/out groove portion 39 is formed to be in communication with the first region 36, the movable portion in/out groove portion 39 may have a fore end in communication with the first region 36 and a rear end closed. The guide rail 34 may be formed in the upper side guide member 18 of the water tank 10. The guide rail 34 may fix the water inlet retreat position P3 of the water supply platform 12 and the water inlet advance position P4 of the water supply platform 12. If the fore end 32A of the movable portion 32 reaches to the fore end 34A of the guide rail 34, the water supply platform 12 is blocked by the fore end 34A of the guide rail 34 and is unable to move further, enabling the water supply platform 12 to maintain the water inlet advance position P4. If the rear end 32B of the movable portion 32 reaches to the rear end 34B of the guide rail 34, the water supply platform 12 is blocked by the rear end 34*b* and is unable to retreat any further, enabling the water supply platform 12 to maintain the water inlet retreat position P3. And, when the water supply platform 12 is at the water inlet retreat position P3, the movable portion 32 may come out of the guide rail 34 through the movable portion in/out groove portion 39, and when the movable portion 32 is positioned at the water inlet retreat position P3, the water supply platform 12 may be in a state in which the water supply platform 12 is separable from the water tank 10.

The movable portion 32 may have a front/rear direction length M shorter than a front/rear direction length P of the movable portion in/out groove portion 39. When the water supply platform 12 is being mounted to the water tank 10, the movable portion 32 may enter into the movable portion in/out groove portion 39 from an upper side of the movable portion in/out groove portion 39, and may be seated on the guide rail 34. When the movable portion 32 is seated on the guide rail 34, the movable portion 32 has a rear end blocked by the rear end of the guide rail 34 unable to move backward, when the water supply platform 12 is positioned at the water inlet retreat position P3. The movable portion 32 is movable forward from the movable portion in/out groove portion 39, and if the movable portion 32 moves forward, the movable portion 32 may proceed to the first region 35. The movable portion 32 may move forward guided by the first region 35. While the movable portion 32 is guided by the first region 35, the water supply platform 12 may be guided forward, horizontally. The movable portion 32 may proceed to the second region 36 from the first region 35, and may pass the second region 36. The movable portion 32 may proceed to the third region 38 from the second region 36, while a front portion of the movable portion 32 is guided to the third region 38, a rear end of the movable portion 32 may be guided to a lower side of the second region 36, and while the movable portion 32 is guided from the second region 36 to the third region 38 gradually, the movable portion 32 is positioned sloped upward gradually, enabling the water supply platform 12 to move sloped upward gradually. If the fore end of the movable portion 32 reaches to the fore end 34A of the third region 38, the fore end of the movable portion 32 is blocked by the fore end 34A of the third region 38 and is unable to move further forward. The water supply platform 12 does not move forward when the water supply platform 12 is positioned at the water inlet advance position P4.

The first water line 7 may be arranged such that the water is introduced to the first water line 7 from the cavity W. The first water line 7 may be arranged at at least one of the water supply platform 12 and the water tank 10. The first water line 7 may include at least one tube through which water from the cavity W passes. The first water line 7 may be connected to the second water line 8 shown in FIGS. 1 and 8 to 10. The second water line 8 is connected to the first water line 7 for guiding the water pumped to the first water line 7 by the water pump 6. The second water line 8 guides the water introduced thereto from the first water line 7 in a state in which the second water line 8 is always connected to the first water line 7. The second water line 8 may be a flexible tube which can be bent or folded, or an extendable bellows tube. The second water line 8 may be connected to the first water line 7 as one end of the second water line 8 is inserted therein. The second water line 8 may be connected to the first water line 7 as a portion of the first water line 7 is inserted in one end of the second water line 8. The first water line 7 may be arranged in the water tank 10 to guide the water pumped from the water tank to the second water line 8, or may be arranged in the water supply platform 12 to guide the water pumped from the water tank to the second water line 8. If the first water line 7 is arranged in the water supply platform 12, washing or cleaning may be easy. The first water line 7 may include a vertical tube 52 that extends vertically, and a horizontal tube 54 connected to a top side of the vertical tube 52 extended in a front/rear direction.

Figure 12:
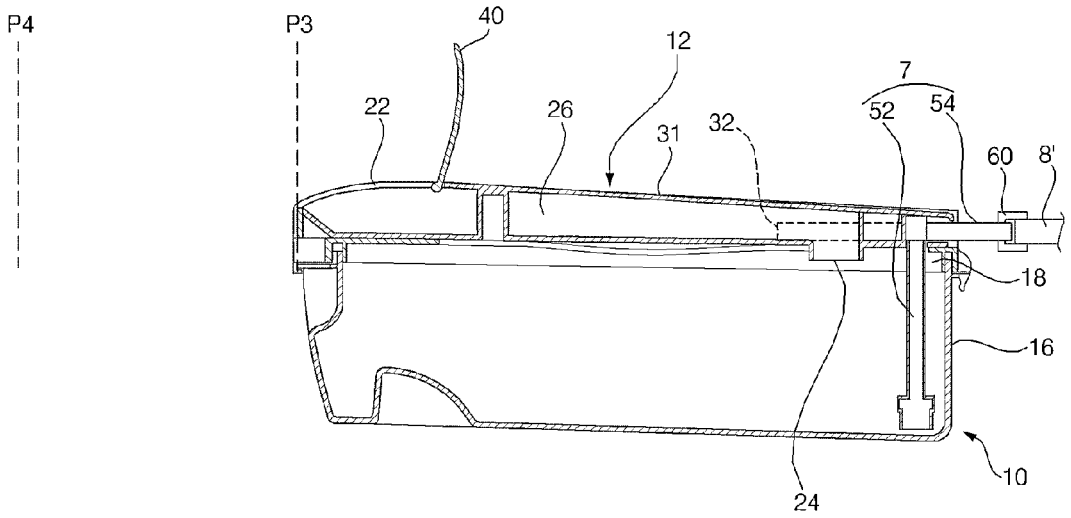
FIG. 12 illustrates a sectional view illustrating an example water tank unit showing a state in which the water supply platform and a guide hose are coupled.
Figure 13:
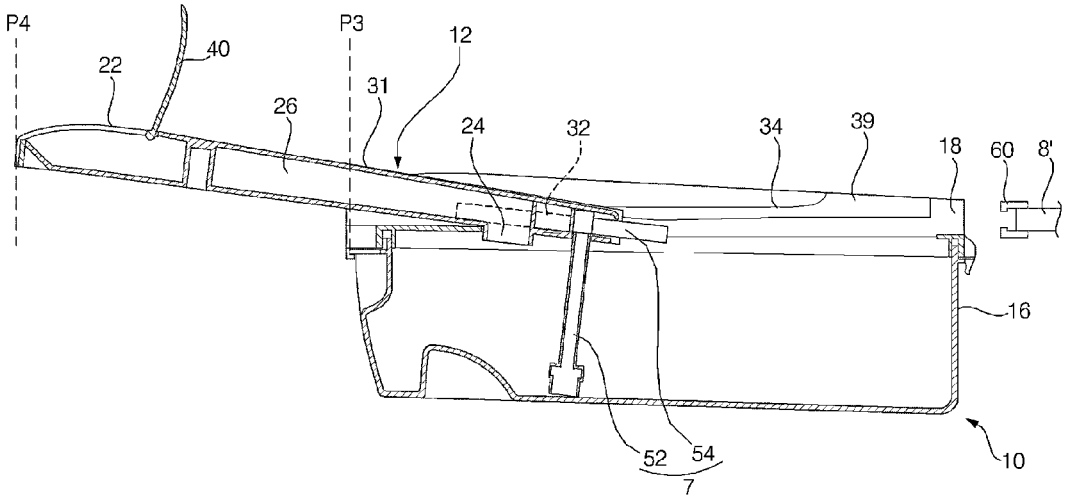
FIG. 13 illustrates a sectional view illustrating an example water tank unit showing a state in which the water supply platform is separated from a guide hose.

FIG. 12 illustrates an example water tank unit showing a state in which the water supply platform and a guide hose are coupled, and FIG. 13 illustrates an example water tank unit showing a state in which the water supply platform is separated from a guide hose.

In some implementations, the refrigerator may have the first water line 7 separated from a second water line 8' when the water supply platform 12 is moved forward from the water inlet retreat position P3. If the water supply platform 12 is moved to the water inlet retreat position P3 in a state in which the first water line 7 is separated from the second water line 8', the first water line 7 may be connected to the second water line 8'. The second water line 8' may be mounted to the cabinet 2 such that a fore end position of the second water line 8' is fixedly secured, and, depending on a position of the water supply platform 12, the first water line 7 and the second water line 8' may be connected to/disconnected from each other.

The refrigerator may further include a sealing member 60 for sealing between the first water line 7 and the second water line 8' if the first water line 7 and the second water line 8' are connected to/disconnected from each other depending on a position of the water supply platform 12. The sealing member 60 may be mounted to either one of the first water line 7 and the second water line 8', for connecting/disconnecting to the other one when the water supply platform 12 is moved.

In some examples, when the water tank 10 is at the water tank retreat position P1 and the water supply platform 12 is at the water inlet retreat position P3, the refrigerator may have the first water line 7 connected to the second water line 8', and when the water tank 10 is moved forward from the water tank retreat position P1 or the water supply platform 12 is moved forward from the water inlet retreat position P3, the first water line 7 may be disconnected from the second water line 8'.

Since other configurations and operations are identical or similar to the examples described above, except that the position of the second water line 8' is fixedly secured, and the first water line 7 is connected to/disconnected from the second water line 8' depending on the position of the water supply platform 12, detailed description of other configurations and operations are referenced, rather than repeated.

Figure 14:
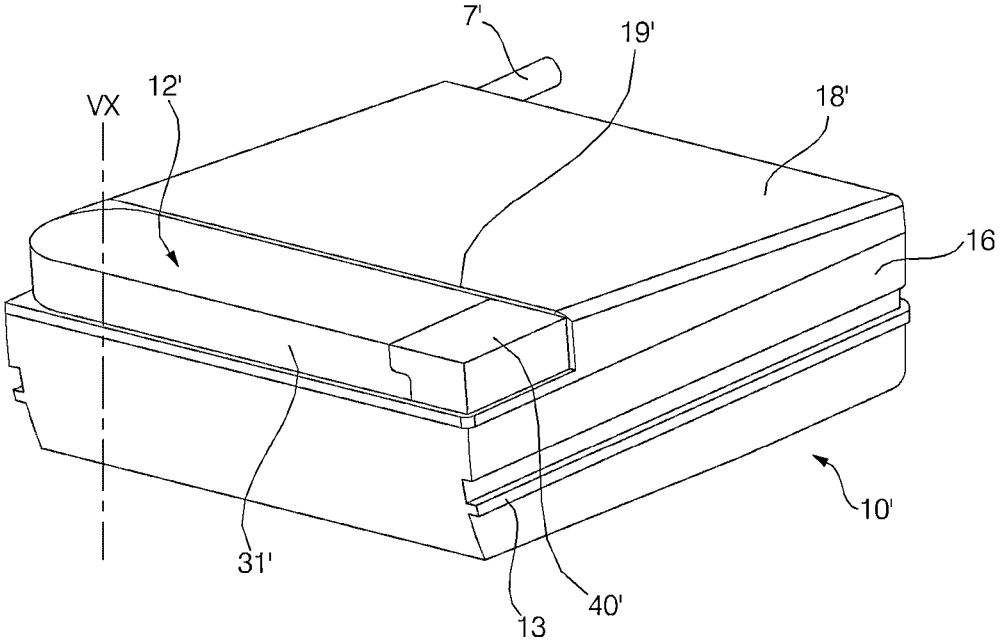
FIG. 14 is a perspective view illustrating an example water tank unit showing a state in which the water supply platform is positioned at a water inlet retreat position.
Figure 15:
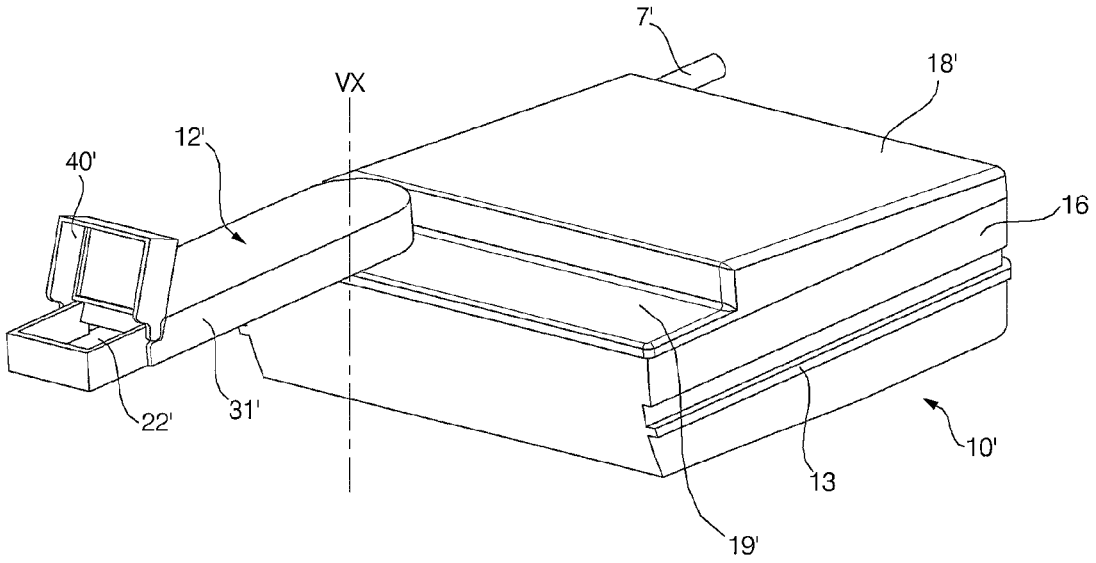
FIG. 15 is a perspective view illustrating an example water tank unit showing a state in which the water supply platform is positioned at a water inlet advance position.
Figure 16:
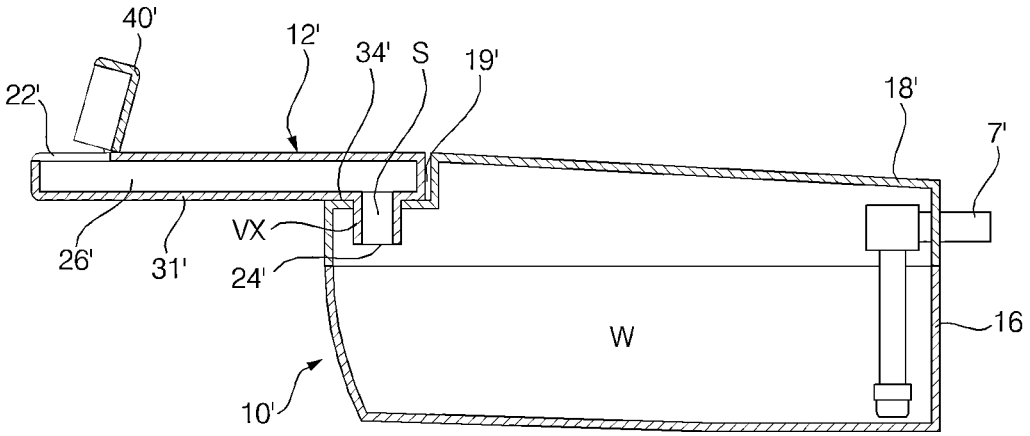
FIG. 16 illustrates a sectional view illustrating an example water tank unit showing configuration of key parts.

FIG. 14 illustrates an example water tank unit showing a state in which the water supply platform is positioned at a water inlet retreat position, FIG. 15 illustrates an example water tank unit showing a state in which the water supply platform is positioned at a water inlet advance position, and FIG. 16 illustrates an example water tank unit showing configuration of key parts.

In some examples, the refrigerator may have a water supply platform 12' rotatably guided by a water tank 10'. The water supply platform 12' may be rotatably arranged to the water tank 10'. The water supply platform 12' may include a body portion 31' and a movable portion, and the movable portion may include a hinge shaft VX rotatably connected to the water tank 10'. The body portion 31' may rotate centered on the hinge shaft VX. The hinge shaft VX enables the body portion 31' to move such that a water inlet 22' is moved from an inside of the cabinet 2 to an outside of the cabinet 2, or vice versa. The body portion 31' may be a box having a rod shape or a bar shape. The body portion 31' may be arranged on the upper side of the water tank 10' extended in a lateral direction, such that the body portion 31' extends in a front/rear direction if the body portion 31' is rotated centered on the hinge shaft VX. When extended in the lateral direction, the body portion 31' may be positioned on the upper side of the water tank 10', entirely. When extended in the front/rear direction, the body portion 31' may have only a portion of a rear portion thereof positioned on the upper side of the water tank 10' and a major portion may be positioned in front of the water tank 10' except the portion positioned on the upper side of the water tank 10.

The body portion 31' may have the water inlet 22', a water outlet 24', and a water supply flow passage 26' formed therein.

Similar to other examples described above, the water inlet 22 may supply water to the water supply platform 12' from an outside of the refrigerator. The water inlet 22' may be formed in an upper side of the body portion 31'. The water inlet 22' may be formed to be positioned at an opposite side of the hinge shaft VX of the body portion 31'. The water inlet 22' may be opened in an upper plate of the body portion 31' in a vertical direction, the hinge shaft VX may be projected from a lower plate of the body portion 31' vertically, and the water inlet 22' and the hinge shaft VX may be spaced in a diagonal direction of the body portion 31'. The water inlet 22' may vary a position thereof while drawing a circular locus when the water supply platform 12' is rotated.

The water outlet 24' may be formed at a position close to the hinge shaft VX of the body portion 31' or in the hinge shaft VX itself. The water outlet 24' may be formed separate from the hinge shaft VX, and the water outlet 24' may be formed under the hinge shaft VX. If the water outlet 24' is formed under the hinge shaft VX, the hinge shaft VX may have a water outlet passage S formed therein for guiding the water to the water outlet 24'. The water introduced to the water inlet 22' may flow to an upper side of the hinge shaft VX through a water supply flow passage 26', and, therefrom, to an inside of the water tank 10' through the water outlet 24' after introduction to the water outlet passage S in the hinge shaft VX. If the water outlet 24' is formed under the hinge shaft VX, the water outlet 24 may cause water to drop to the inside of the water tank 10' in a state in which the water outlet 24' is positioned in the water tank 10'. If the water outlet 24' is formed separate from the hinge shaft VX, the water tank 10' may have an opening formed therein in communication with the water outlet 24' regardless of the position of the water supply platform 12'. In this case, the opening may be formed in a circular shape in the upper side of the water tank 10', and the water outlet 24' may have a position varied within the upper side of the water outlet 24'.

The water supply flow passage 22' may be formed within the body portion 31' extended in a length direction of the body portion 31'.

The refrigerator may further include an water inlet door 40' mounted to the body portion 31' to open/close the water inlet 22'. Similar to other examples described above, the water inlet door 40' may be rotatably mounted to the water supply platform 12'.

The water tank 10' may have a water supply platform housing 19' recessed therein for inserting and housing the water supply platform 12' therein. The water supply platform housing 19' may be formed on the upper side of the water tank 10' extended in the lateral direction, for housing the water supply platform 12' when the water supply platform 12 is extended in the lateral direction. The water tank 10' may have a rotation hole 34' formed therein for rotatably supporting the hinge shaft VX. The rotation hole may be formed in the water supply platform housing 19'.

The water tank 10' may have a first water line 7' arranged therein for introduction of the water thereto from the cavity W and passing of water therethrough. The first water line 7' may be provided to the water tank 10'. Similar to other examples described above, the water tank 10' may include a box 16, and an upper side guide member 18', the water supply platform housing 19' and the rotation hole 34' may be formed in the upper side guide member 18', and the first water line 7' may be arranged on the upper side guide member 18'.

Since other configurations and operations are similar or identical to one example and/or another example, detailed description of the other configurations and operations of the examples will be referenced, rather than repeated.

Although example refrigerators have been described with reference to the illustrated drawings, it will be apparent to those skilled in the art that the present disclosure is not intended to be limited to the above-described examples and drawings, and various changes or modifications may be made therein without departing from the scope and the technical sprit of the present disclosure.

What is claimed is:

1. A refrigerator comprising:

a cabinet;

a water tank supporter arranged in the cabinet;

a water tank that is supported by the water tank supporter and that defines a cavity; and a water supply platform that is movably connected to the water tank, the water supply platform including:

a body portion that has a water inlet, a water outlet configured to discharge water to the cavity, and a water supply flow passage connected between the water inlet and the water outlet; and a movable portion that is connected to the water tank, and that is configured to move the body portion relative to the water tank such that the water inlet moves from an inside of the cabinet to an outside of the cabinet or vice versa, wherein the water tank is configured to move to a first position based on the water tank sliding horizontally to an inside of the cabinet, and is configured to move to a second position based on the water tank sliding horizontally to an outside of the cabinet from the first position, wherein the water supply platform is configured to move to a water inlet retreat position to cover the cavity defined by the water tank, is configured to move to a water inlet advance position to open a portion of the cavity defined by the water tank, and is configured to move farther outside the cabinet than the water tank based on the water supply platform being located at the water inlet advance position, and wherein the water inlet is positioned in front of a vertical extension line which is a downward extension line from an end of a freezing chamber door based on the water tank being located in the second position and the water supply platform being located in the water inlet advance position.

2. The refrigerator of claim 1, wherein the water tank includes a water tank movable portion movably connected to the water tank supporter.

3. The refrigerator of claim 1, wherein the water tank has a water supply platform housing configured to house the water supply platform.

4. The refrigerator of claim 3, wherein the water supply platform housing has opened upper and front sides.

5. The refrigerator of claim 1, wherein the water tank has a guide rail configured to guide sliding movement of the movable portion of the water supply platform.

6. The refrigerator of claim 5, wherein the movable portion of the water supply platform is located on a side plate of the body portion of the water supply platform and is configured to extend in a front/rear direction.

7. The refrigerator of claim 5, wherein the guide rail includes a first region and a second region that has a width greater than a width of the first region.

8. The refrigerator of claim 6, wherein the guide rail includes a third region that has a width less than a width of the second region, and that has a closed fore end.

9. The refrigerator of claim 8, wherein the third region has a sloped portion that is oriented at an acute angle from a horizontal plane.

10. The refrigerator of claim 7, wherein the guide rail further includes a groove portion in communication with the first region or the second region.

11. The refrigerator of claim 10, wherein the groove portion has a vertical direction opening, a fore end in communication with the first region, and a closed rear end.

12. The refrigerator of claim 11, wherein the movable portion has a front/rear direction length shorter than a front/rear direction length of the groove portion.

13. The refrigerator of claim 1, wherein the movable portion includes a hinge shaft movably connected to the water tank.

14. The refrigerator of claim 1, wherein the water supply platform includes:

a lower plate, an upper plate including the water inlet, and side plates connected between the upper plate and the lower plate.

15. The refrigerator of claim 14, wherein the water outlet is formed in the lower plate.

16. The refrigerator of claim 14, wherein the water supply platform further includes a water guide that defines the water supply flow passage.

17. The refrigerator of claim 1, wherein the water supply platform includes:

a slidable plate including the water inlet; and a tube that defines the water outlet.

18. A refrigerator comprising:

a cabinet;

a water tank supporter mounted in the cabinet;

a water tank that is movably connected to the water tank supporter and that defines a cavity;

a water supply platform that is movably connected to the water tank, the water supply platform including:

a body portion that has a water inlet, a water outlet configured to discharge water to the cavity, and a water supply flow passage connected between the water inlet and the water outlet; and a movable portion that is connected to the water tank, and that is configured to move the body portion relative to the water tank such that the water inlet moves from an inside of the cabinet to an outside of the cabinet or vice versa;

a water pump;

a first water line arranged in the cavity; and a second water line connected to the water pump, wherein the water tank is configured to move to a first position based on the water tank sliding horizontally to an inside of the cabinet, and is configured to move to a second position based on the water tank sliding horizontally to an outside of the cabinet from the first position, wherein the water supply platform is configured to move to a water inlet retreat position to cover the cavity defined by the water tank, is configured to move to a water inlet advance position to open a portion of the cavity defined by the water tank, and is configured to move farther outside the cabinet than the water tank based on the water supply platform being located at the water inlet advance position, and wherein the water inlet is positioned in front of a vertical extension line which is a downward extension line from an end of a freezing chamber door based on the water tank being located in the second position and the water supply platform being located in the water inlet advance position.

19. The refrigerator of claim 18, wherein the second water line includes a flexible tube connected to the first water line.

20. The refrigerator of claim 18, wherein the second water line is separated from the first water line based on the water tank moving forward, and connected to the first water line based on the water tank retreating further into the cabinet.

21. The refrigerator of claim 18, wherein the water tank has a water supply platform housing configured to house the water supply platform.

22. The refrigerator of claim 18, wherein the water tank has a guide rail configured to guide sliding movement of the movable portion.

23. The refrigerator of claim 22, wherein the guide rail includes a sloped portion configured to guide the movable portion in a manner that tilts the movable portion upward based on the movable portion moving forward.

24. A refrigerator comprising:

a cabinet;

a water tank supporter arranged in the cabinet;

a water tank that is connected to the water tank supporter and that defines a cavity; and a water supply platform that is movably connected to the water tank, the water supply platform including:

a body portion that has a water inlet, a water outlet configured to discharge water to the cavity, and a water supply flow passage connected between the water inlet and the water outlet; and a movable portion that is connected to the water tank, and that is configured to move the body portion relative to the water tank such that the water inlet moves from an inside of the cabinet to an outside of the cabinet or vice versa, wherein the water tank includes:

a box that defines the cavity, and an upper side guide member that is arranged at an upper side of the box and that is configured to guide movement of the water supply platform, wherein the water tank is configured to move to a first position based on the water tank sliding horizontally to an inside of the cabinet, and is configured to move to a second position based on the water tank sliding horizontally to an outside of the cabinet from the first position, wherein the water supply platform is configured to move to a water inlet retreat position to cover the cavity defined by the water tank, is configured to move to a water inlet advance position to open a portion of the cavity defined by the water tank, and is configured to move farther outside the cabinet than the water tank based on the water supply platform being located at the water inlet advance position, and wherein the water inlet is positioned in front of a vertical extension line which is a downward extension line from an end of a freezing chamber door based on the water tank being located in the second position and the water supply platform being located in the water inlet advance position.

25. The refrigerator of claim 24, wherein the water tank further includes a water tank movable portion connected to the water tank supporter and configured to move in forward and backward directions.

26. The refrigerator of claim 24, wherein the upper side guide member has a water supply platform housing configured to house the water supply platform.

27. The refrigerator of claim 26, wherein the water supply platform housing has opened upper and front sides.

28. The refrigerator of claim 26, wherein the water supply platform housing has a guide rail configured to guide sliding movement of the movable portion.

29. The refrigerator of claim 28, wherein the movable portion is located on side plates of the body portion and is configured to extend in a front/rear direction.

30. The refrigerator of claim 28, wherein the movable portion has a fore end that catches at a fore end of the guide rail based on the water inlet being moved to a position outside of the cabinet, and a rear end that catches at a rear end of the guide rail based on the water inlet being moved to a position inside of the cabinet.

31. The refrigerator of claim 24, wherein the water supply platform includes:

a lower plate, an upper plate including the water inlet, and side plates connected between the upper plate and the lower plate.

32. The refrigerator of claim 31, wherein the water outlet is formed in the lower plate.

33. The refrigerator of claim 24, wherein the water supply platform includes:

a slidable plate where the water inlet and the water supply flow passage are formed, and a tube connected to the slidable plate that is configured to define the water outlet.

* * * * *